United States Patent [19]

Molenaar et al.

[11] Patent Number: 5,058,864

[45] Date of Patent: Oct. 22, 1991

[54] METHOD OF MANUFACTURE OF PIG IRON USING HOLLOW TUBE TO RESEAL TAP ROLE

[75] Inventors: Ronald N. Molenaar, Heemskerk; Rienk M. Nijholt, Noord-Scharwoude, both of Netherlands

[73] Assignee: Hoogovens Groep BV, Ijmuiden, Netherlands

[21] Appl. No.: 665,475

[22] Filed: Mar. 6, 1991

[30] Foreign Application Priority Data

Mar. 12, 1990 [NL] Netherlands ..... 9000556

[51] Int. Cl.[5] ..... C21B 7/12

[52] U.S. Cl. ..... 266/45; 75/467; 75/584; 266/271

[58] Field of Search ..... 75/467, 584; 266/45, 266/205, 271, 272, 273

[56] References Cited

U.S. PATENT DOCUMENTS 3,618,926 11/1971 Barnat .
4,909,487 3/1990 Schneider ..... 266/273
4,960,379 10/1990 Schneider ..... 266/45

FOREIGN PATENT DOCUMENTS 9006377 6/1990 European Pat. Off. ..... 266/45
2630130 10/1989 France .
1127612 5/1989 Japan ..... 266/45

OTHER PUBLICATIONS

T. Nagai, Patent Abstracts of Japan, vol. 7, No. 66 (C157) [1211], 03/18/83.
S. Hogi, Patent Abstracts of Japan, vol. 7, No. 118 (C-167) [1263], 05/21/83.
T. Yamane, Patent Abstracts of Japan, vol. 12, No. 202 (C-503) [3049], 06/10/88.

*Primary Examiner*—Melvyn J. Andrews
*Attorney, Agent, or Firm*—Stevens, Davis, Miller & Mosher

[57] ABSTRACT

In the manufacture of pig-iron in a shaft furnace, a taphole is closed with hardened plugging compound during making of the iron and is opened for the tapping of the iron and then resealed. The resealing of the taphole comprises inserting hardenable plugging compound into the taphole and, before hardening thereof, driving a hollow tube into the plugging compound. The hollow tube has an open front end. The tube is pulled out at the next tapping. The use of a tube avoids disturbance of the plugging compound and creates a smoother taphole, leading to improved flow of liquid iron.

6 Claims, 2 Drawing Sheets

METHOD OF MANUFACTURE OF PIG IRON USING HOLLOW TUBE TO RESEAL TAP ROLE

BACKGROUND OF THE INVENTION

1. Field of the Invention

The invention relates to a method for the manufacture of pig iron in a shaft furnace, more particularly a blast furnace, wherein a taphole of the shaft furnace is opened and pig iron is tapped off from the shaft furnace via the opened taphole, and thereafter the taphole is sealed off by placing plugging compound in the taphole. Such a method is known from the practice of making pig iron in a blast furnace. It is also known to use two tapholes which are operated alternately so that at any time only one taphole is opened for tapping off pig iron from the shaft furnace.

2. Description of the Prior Art

Various methods are used for opening the taphole. One known method is to make a hole in the furnace wall using a drill, which is no easy matter, among other reasons because of the length of the taphole to be made (approximately 2 to 3 meters), and the characteristics of the material of the furnace wall. A particular disadvantage of this method is that the wall of the drilled taphole is not smooth, with the result that the flow front of the pig iron flowing out of the blast furnace via the opened taphole is inhomogeneous. This means that in addition to the primary iron flow (the main flow), so-called secondary flows occur, whereby so-called "sprays" result. The said secondary flows are characterized by a seriously reduced out-flow speed compared with the primary flow. These secondary flows tend to solidify a short distance after leaving the shaft furnace. These solidified secondary flows make it difficult to re-seal the taphole after tapping off because they solidify at least in part in front of the taphole and there form a partial blockage. Moreover, these solidified secondary flows are difficult to remove, which represents a disadvantage for the working conditions of the operating personnel.

An alternative method to this is used in which as soon as tapping off via the taphole is finished, a soft yet hardening plugging compound is placed in the taphole, into which plugging compound a knock rod is then knocked in. The taphole is then opened at the next tapping simply by pulling the rod out again. This method is described for example in JP-A-58-39711 (1983). Compared with the drilling method for opening the taphole, this method has the advantage that it is relatively fast and produces more smoothly finished taphole. However, the method does present the problem that the knock rod has to be knocked into the taphole during a very brief period of time, shortly after the taphole is plugged with the plugging compound, because the plugging compound starts to harden after only a few minutes and in some spots very quickly. As soon as the plugging compound has hardened, or at least has become harder, the problem during knocking in of the knock rod is that the surroundings of the taphole become damaged because the rod and the plugging compound located in front of the rod sticks in the taphole. An additional disadvantage of this method is that, as the plugging compound hardens, it becomes very hard to knock in the rod, and sometimes it can only be knocked into the taphole to a limited extent.

Another method of taphole sealing and reopening involving insertion of a metal rod is shown in JP-A-63-7308 (1988). The rod is inserted together with a ceramic sleeve. The rod is melted, in order to open the taphole. JP-A-58-1007 (1983) describes driving of a ceramic tube into the soft plugging material. The tube is packed and sealed. The tube defines the next taphole. FR-A-2630130 also proposes insertion of a ceramic tube.

SUMMARY OF THE INVENTION

An object of the invention is to provide a simple technique for the resealing and opening of a taphole, wherein the advantages of the method using a rod are retained and the disadvantages avoided.

The method in accordance with the invention is characterized in that the rod is a hollow tube having an open front end which is pushed into the plugging compound placed in the taphole to seal it off, and in that the taphole is opened by removing the tube from the taphole. The tube is of suitable metal, preferably steel.

The method in accordance with the invention has the advantage that when the tube is being inserted no plugging compound (or hardly any) displaces in the longitudinal direction of the taphole thereby avoiding damage to the partially hardened or hardening plugging compound and the taphole.

After removal of the tube, the method in accordance with the invention also produces a smooth finished taphole and has further advantages which will be discussed below.

It is desirable for the tube to be pushed in over the entire length of the taphole of the shaft furnace, or almost the entire length. It is further preferable for the open front end of the tube to have a blade shape with an edge aligned with inner wall surface of the tube, e.g. so that the length of the cylindrical inner wall of the tube is greater than the length of the cylindrical outer wall of the tube. In this way compaction of the taphole wall is obtained as the hollow tube is knocked in, whereby after removal of the tube the taphole is provided with a stronger wall whose smooth finish is better retained during tapping off.

It is an advantage to select the tube wall thickness to depend on the required compaction of the taphole wall. By selecting a greater thickness of the wall of the tube, the intended compaction of the taphole wall may be improved.

Inserting the tube into and removing the tube from the taphole can take place easily by a knocking action.

The method in accordance with the invention achieves almost total avoidance of the aforementioned secondary iron flows. A more compact tapping off flow occurs, which also has a reproducible tapping off speed due to the accurate control of taphole diameter made possible by the invention.

An advantage of the method in accordance with the invention compared with the known state of the art is also that removal of the hollow tube can take place in only about half a minute, thereby increasing effective tapping off time and enabling greater production volumes for a given blast furnace content and hearth diameter. Moreover, another advantage is achieved in that when using more than one taphole, alternate tapping operations per taphole may follow on from each other more accurately so that the quality of the pig iron tapped off is the same for both tapholes. It is believed that this is caused because the bath surface of the liquid iron and slag in the furnace undergoes hardly any change, and successive tapholes allow an almost identically composed iron/slag mix to be tapped off.

In this connection too, maintenance of the quality of the pig iron tapped off is also achieved by the aforementioned reproducibility of the tapping off speed which the invention makes possible. Consequently the quality of the pig iron produced by the furnace becomes less dependent on which taphole is used to tap off pig iron from the furnace.

By the aforementioned compacting of the taphole wall resulting from insertion of the hollow tube, as well as in that connection the virtual lack of displacement of the plugging compound in the taphole as the hollow tube is being inserted, damage to the taphole is kept to a minimum, and this taphole is of stable quality which allows a more manageable tapping off procedure to be obtained.

BRIEF INTRODUCTION OF THE DRAWING

An embodiment of the invention will now be described by way of non-limitative example, with reference to the accompanying drawings, in which:

FIG. 1 is a vertical cross sectional view of a taphole portion of a shaft furnace to which the invention is applied, and FIG. 2 is an axial sectional view of a tube member which is inserted into the taphole.

DESCRIPTION OF THE PREFERRED EMBODIMENT

Figure 1:
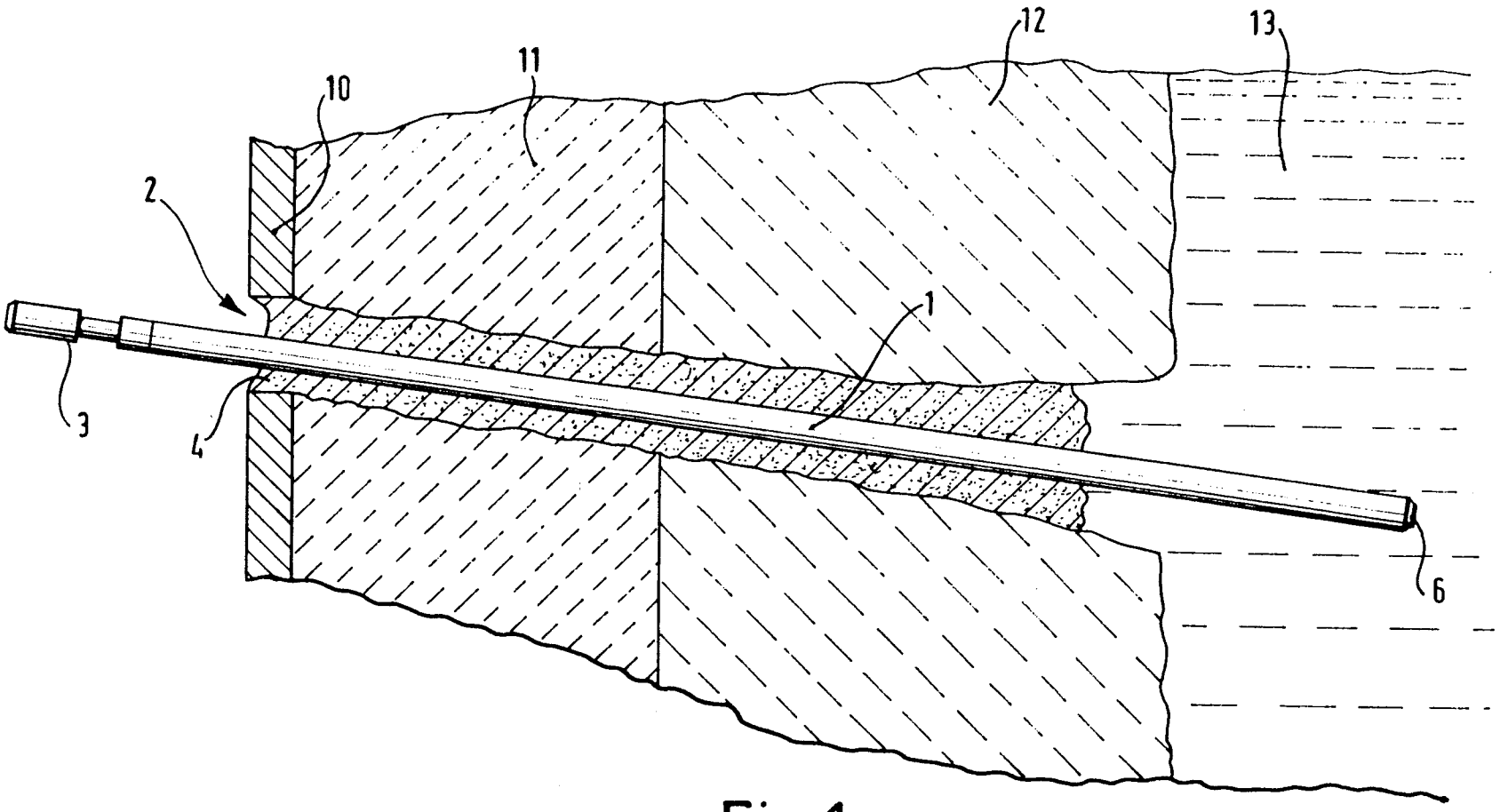

Referring to FIG. 1, there is shown a portion of a side wall of a shaft furnace, e.g. a blast furnace, for making pig iron. This portion has a taphole 2. The wall has an outer steel cladding 10, a permanent refractory lining 11 and a wearing refractory lining 12. Molten pig iron is indicated at 13. The taphole 2 of the wall is shown filled with a hardened mass of plugging compound 4 into which is inserted, as described below, a hollow metal tube 1 having an inner open end 6 and having a shaped solid steel fitting 3 welded to its other, outer end. The tube 1 is of mild steel.

Figure 2:
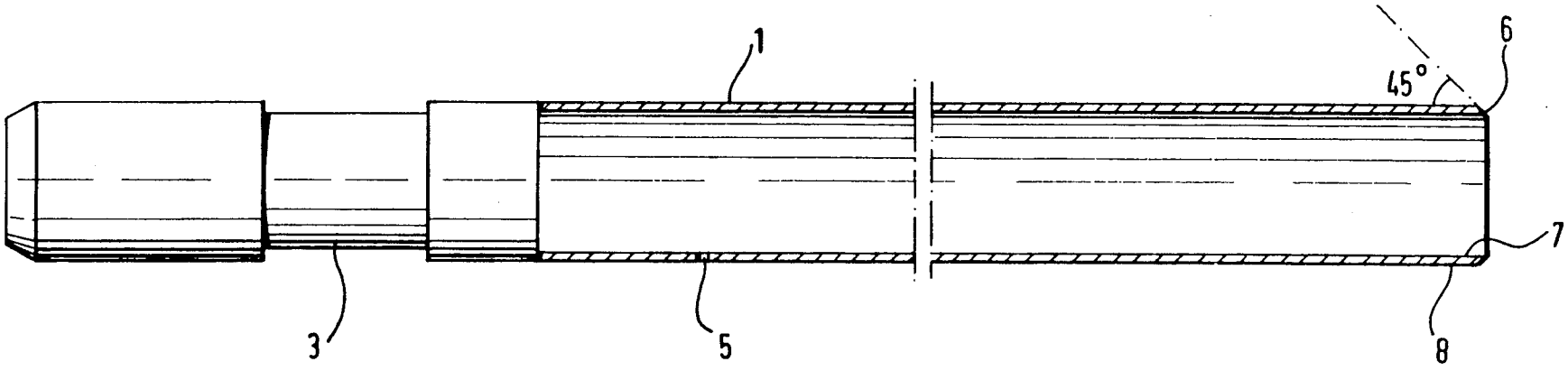

As FIG. 2 shows, the tube 1 has, near its outer end, a air escape hole 5. Its inner end 6 is of blade-shape, with a 45° bevel, so that the blade edge is the extremity of the inner face 7 of the tube, i.e. the blade edge is aligned with the inner face 7. Thus the cylindrical portion of the outer face 8 ends at a small distance from the extremity of the inner face, thereby providing the bevelled blade-like shape.

Although in FIG. 1 the tube 1 is shown projecting into the molten iron 13 in practice the exposed portion may be destroyed by the processes in the furnace.

FIG. 1 shows the state of the taphole during the preparation of the pig iron in the furnace, prior to tapping. The tapping operation is conducted as follows. When it is desired to start tapping of the furnace, the hollow tube 1 is removed from the taphole by applying an appropriate device to the solid end 3. Such devices are known in the art, and involve a knocking or hammering action to extract the tube 1. This extraction of the tube 1 leaves a relatively smooth-walled hole, along which tapping begins. During the tapping of the pig iron, the hole becomes enlarged, in the normal way. When tapping has been completed, further soft plugging compound, hardenable by the heat of the furnace, is inserted into the now-enlarged taphole. While this plugging compound is hardening, but is still sufficiently soft, a hollow tube 1 as shown in FIG. 2 is driven through it by a hammering device, so as to project from the inner end of the plugging mass 4.

Because the tube 1 is hollow and has an open end 6, the insertion of the tube can take place easily, and the stat of the plugging compound can be harder than in the case where a solid rod is used. This means that less distortion of the plugging compound takes place. Furthermore, since the plugging compound partly fills the tube 1, it is not pushed in front of the tube 1 while it is inserted, or is only slightly pushed in front of it. A secure and solid sealing of the taphole 2 is thus achieved. Another advantage which can be obtained is that the blade-shape of the leading end of the tube 1 shown in FIG. 2 pushes the plugging compound radially outwardly from the tube as it is inserted, thereby compacting the plugging compound better.

The shape of the tube, and the fact that it is more easily pushed into the plugging compound than a solid rod, means that the wall of the taphole is obtained when the tube is pulled out is smoother than with a solid rod.

The air hole 5 allows air to escape from the tube a the plugging compound enters during insertion of the tube.

The thickness of the wall of the tube 1 may be selected so as to provide a suitable compaction of the taphole wall. Preferably this thickness is about 5 mm, but it may range from 2 to 10 mm. A preferred value of the tube diameter is about 50 mm, but this may range from 30 mm to 100 mm.

As mentioned, the tube 1 is preferably inserted over the whole length of the taphole, in order to allow the opening of the taphole to be effected simply by removal of the tube 1, without any further operation. Typically for a taphole of length 2.5 m a tube 1 of overall length about 3.8 m may be used. An alternative method is to insert the tube 1 through most, e.g. at least 80% of the plugging mass 4 but not the full length. Then, after the tube 1 has been removed, the remaining length of the taphole can be drilled out as in a conventional process.

As mentioned above, the shape of the leading end 6 of the tube gives a better finish of the taphole wall, and also leads to strengthening of the taphole wall adjacent the outer surface of the tube 1. This improves the flow of the liquid iron from the taphole during tapping, because for example the flow is less affected by turbulence. Consequently, the tapping conditions are more uniform, as between different tapping from the furnace. Because the tappings can follow one another more closely, improved uniformity of the metallurgical operations in the furnace can be achieved, which leads to a higher quality of pig iron produced. One reason for this is that the iron/slag level only slightly changes during the transition period between the use of the tapholes, which is beneficial to the quality of the liquid material being tapped because the iron/slag ratio hardly changes.

The invention may equally be applied to a furnace which has a plurality of tapholes, the method use of a hollow tube 1 as shown in FIG. 2 in each of these tapholes. Such tapholes are often used alternately.

The plugging material 4 can be of conventional kind. A typical low quality material comprises sand, clay, coke and tar. For this, the hardening time may be as much as 60 minutes, and even after 5 minutes it is still possible to insert the tube 1. A high quality material may, as conventional, comprise materials selected from bauxite, corundum, silicon carbide, kyanite, silicon nitride, clay, carbon (coke anthracite), epoxy and binder. The hardening time of such a material can be controlled, e.g. in the range 1 to 30 minutes. The time of insertion of the tube 1 must be selected carefully, in accordance with the hardening process taking place.

A typical tapping time for a pig iron furnace is 2 to 3 hours, and the weight of metal tapped in each tapping may be 600 to 900 tons. Typically the diameter of the taphole at the initial opening (removal of the tube 1) is in the range 40 to 80 mm, and at the end of tapping this may be 200 mm, at least at the inner end of the taphole.

What is claimed is:

1. A method of manufacture of pig-iron in a shaft furnace having at least one taphole which is closed with hardened plugging compound during making of the iron and is opened for the tapping of the iron and then resealed, comprising the steps of (a) resealing of the taphole by (i) inserting hardenable plugging compound into the taphole and (ii) before hardening of said plugging compound, driving a hollow tube having an open end as its leading end into the plugging compound, and (b) at the opening of the taphole pulling said tube out from the hardened plugging compound.

2. A method according to claim 1 wherein said hollow tube is made of steel.

3. A method according to claim 1 wherein said hollow tube is driven in so as to extend along the full length of the taphole.

4. A method according to claim 1 wherein said open end of said tube has a blade shape, with a blade edge aligned with the inside surface of said tube.

5. A method according to claim 1 wherein said tube is driven into the taphole by a knocking action and is removed therefrom by a knocking action.

6. In a method of manufacture of pig iron in a shaft furnace which shaft furnace has at least one taphole sealed by plugging compound during making of the iron, a method comprising the steps of:

at resealing of the taphole after tapping, placing heat-hardenable plugging compound in the taphole to reseal it, and pushing a hollow-tube into the plugging compound, said hollow tube having an open leading end;

at reopening of the taphole for a subsequent tapping removing the tube from the taphole and tapping off pig iron from the shaft furnace via the hole so formed.

* * * * *